United States Patent [19]

Hedrick

[11] 4,422,251

[45] Dec. 27, 1983

[54] APPARATUS FOR QUILTING

[76] Inventor: Virginia L. Hedrick, 1027 E. Francis St., Corona, Calif. 91720

[21] Appl. No.: 30,316

[22] Filed: Apr. 16, 1979

[51] Int. Cl.[3] ..... D05C 1/04

[52] U.S. Cl. ..... 38/102.2

[58] Field of Search ..... 38/102.2

[56] References Cited

U.S. PATENT DOCUMENTS

| | | | |
|---|---|---|---|
| 437,912 | 10/1890 | Anrig | 38/102.2 |
| 1,093,136 | 4/1914 | Jucker et al. | 38/102.2 |
| 2,760,299 | 8/1956 | Gable et al. | 38/102.2 |

*Primary Examiner*—Louis Rimrodt

*Attorney, Agent, or Firm*—Dana E. Keech

[57] ABSTRACT

A quilting frame including inner and outer co-planar closely, uniformly, adjustably fitting rectangular wooden frames, the inner frame being of a rigidly integrally unyielding character, the co-planar adjustability between the inner and outer frames being provided by mitering and rigidly uniting side and end pieces of said outer frame at both ends of one of the diagonals of said outer frame, and mitering and spreadably adjustably uniting the other ends of said side and end pieces of said outer frame located at the opposite ends of the other diagonal of said outer frame, thereby facilitating the joint use of two hands to simultaneously uniformly adjust the radial peripheral spacing of the two rectangular frames, as well as the telescopic spaced correlation of said frames.

3 Claims, 5 Drawing Figures

APPARATUS FOR QUILTING

SUMMARY OF THE INVENTION

The present invention resulted from my discovery, when becoming a quilting teacher three years ago, that the quilting frames then available were simply inadequate for today's needs.

Included among the specific aims of my endeavor to produce a quilting frame more useful to my pupils are the following:

1. In the first place the cost had to be low enough to be within reach of the average housewife.

2. The space required for making quilts on the frame needed to be moderate.

3. The frame needed to possess a facility for ready removal from its shipping package and assembly for use.

4. Once unpacked and assembled, the frame should facilitate its being readily reduced to a compact size fitting, for normal indoor storage into a space already available, such as found behind a door, under a bed, or behind clothes hanging in a closet. 5. I also sought to so design my quilting frame that the manipulation of the vertically adjustable outer frame thereof while simultaneously constricting or expanding the same with respect to the matrix being worked on (and the inner frame supporting this) can be done using both hands simultaneously thereby expanding the quilt production capacity of the frame, and avoiding tiring the operator.

6. Finally, I sought to arrange for the constriction and expansion of the outer frame element of the invention relative to the inner frame element in a manner to minimize wrinkling of the matrix stretched upon the invention. In this search, I discovered that this end is accomplished by the preferred novel, and unobvious embodiment of the present invention disclosed herein.

DETAILED DESCRIPTION OF THE PREFERRED EMBODIMENT

Figure 1:
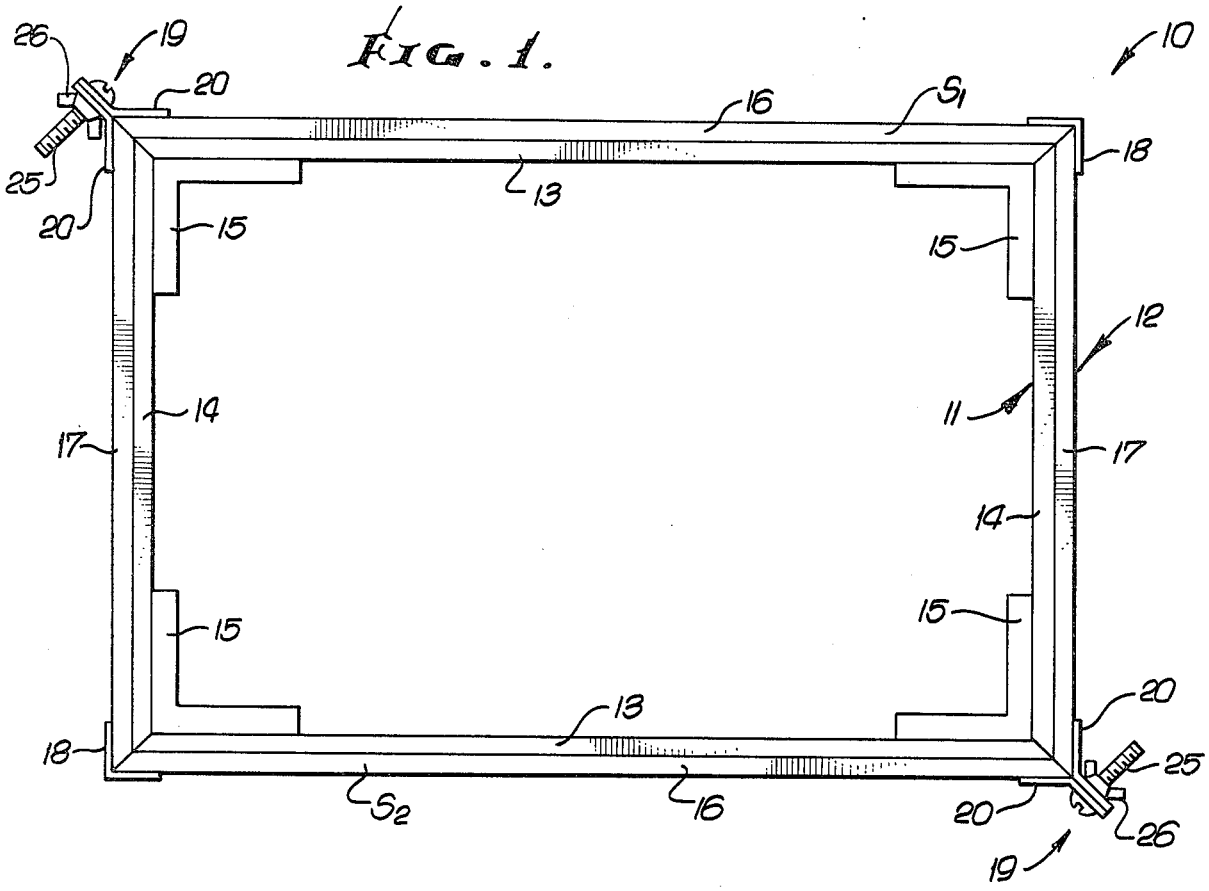
FIG. 1 is a diagrammatic plan view of a preferred form of the apparatus of the invention showing the same readied for storage with the outer frame tightly clamped on the inside frame in co-planar relation therewith. Being extended, the four legs are hidden in this view beneath the angle corner brackets for mounting said legs.
Figure 2:
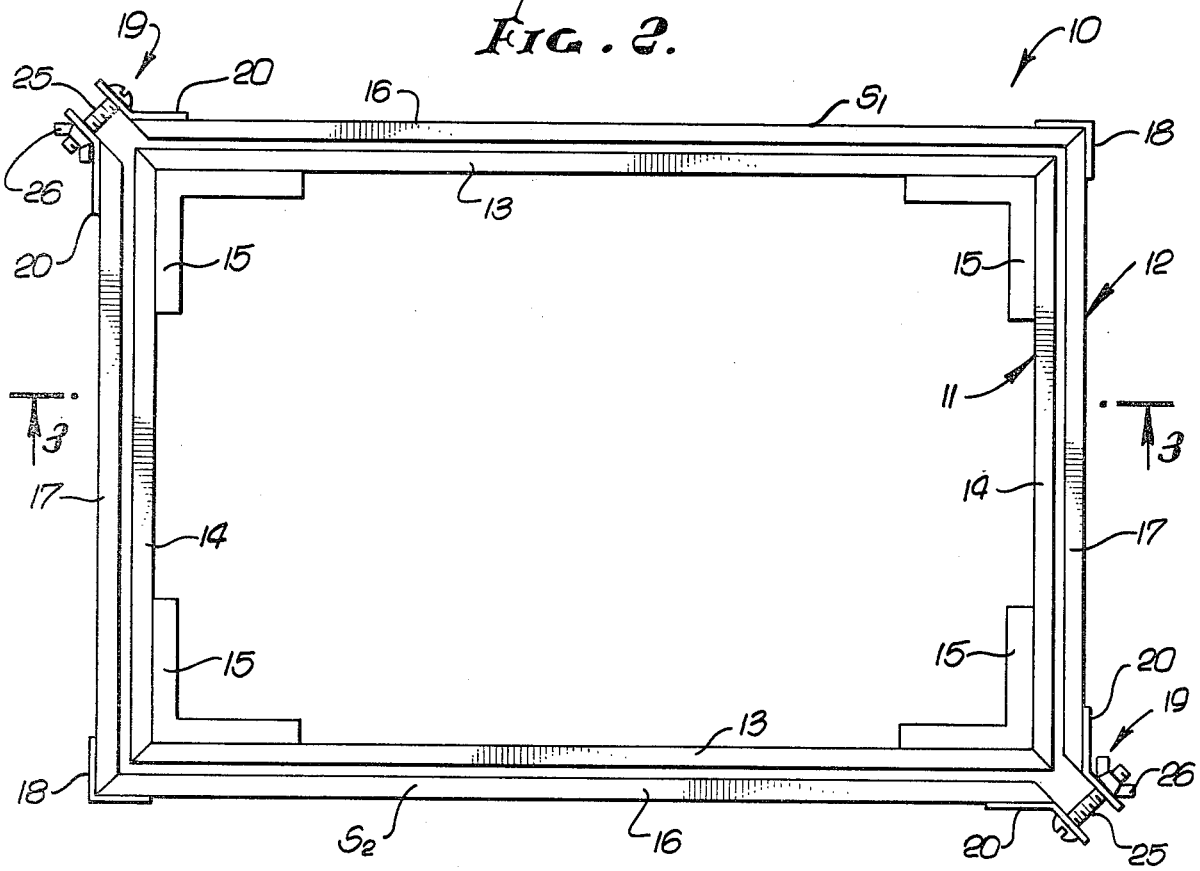
FIG. 2 is a view similar to FIG. 1 with the outer frame of the apparatus expanded by unscrewing the two diagonally opposed screw clamps thereof to provide a uniform half inch outward spacing of said outer frame from said inner frame. This view shows the apparatus empty of quilting material and assumes the provision of some support being provided to hold the outer frame entirely out of contact with the inner frame upon which the outer frame depends for support when it is not being manually supported.

The invention comprises an apparatus 10 including an inner frame 11 and an outer frame 12 both of which are preferably formed of smoothly milled hardwood members $\frac{3}{4}'' \times 1\frac{5}{8}''$, which are mitered 45° for matched juncture with each other at the frame corners. At its four corners the members 13 and 14 of inner frame 1 are rigidly united by $5'' \times 1''$ angle iron brackets 15, these also supporting four folding game table legs (not shown).

The outer frame 12, formed of like hardwood members 16 and 17, is just enough larger than frame 11 to be tightly clampable in coplanar relation upon said inner frame for ease in storing apparatus 10 when not in use. In fact its capacity to be so clamped onto inner frame 11 is derived from the outer frame being required, in performing the invention, to be subject to ready control by the operator in uniformly increasing or decreasing the co-planar radial spacing between said two frames at all points in their periphery. Considerable aid in effecting such control is offered by the fact that most of the time the apparatus is in use, the matrix handled by the apparatus overlies the inner frame 11 and hangs downward on all four sides between the two frames.

The essential clamping character of outer frame 12 is derived from its being divided diagonally into two like rigid right-angular sections $S^1$ and $S^2$ each of which embodies an adjacent pair of side and end members 16 and 17 (of unequal length) with abutting mitered ends of said two members, in each such section being rigidly united at a right angle by a sheet metal right angles bracket 18.

The 45° mitered diagonally opposite free ends of sections $S^1$ and $S^2$ are respectively adjustably united by two like clamps 19 each including a pair of angle brackets 20 subtending angles of 135° and rigidly secured (as by screws) to the adjacent free ends of outer frame members 16 and 17, the parallel extremities of brackets 20 having aligned apertures normal to said extremities through which bolts 25 are extended, to have wing nuts 26 screwed thereon.

OPERATION

In employing the invention, the apparatus 10 thereof is manipulated as follows:

The dimensions of the apparatus disclosed herein are those of a commercial model designed to appeal to the average housewife interested in quilting as an avocation. It is adapted to be used on quilting matrices of a wide range of thicknesses, the ¾" thick matrix M shown in FIGS. 3, 4, and 5 being a mean selected from that range.

As noted above, the inner frame 11 is normally supported at game table height by folding legs (not shown) depending from angle brackets 15. When in storage, the clamps 19 are used to tightly clamp outer frame 12 in co-planar relation with inner frame 11, and the legs are folded in a similar manner to card-table legs.

Figure 3:
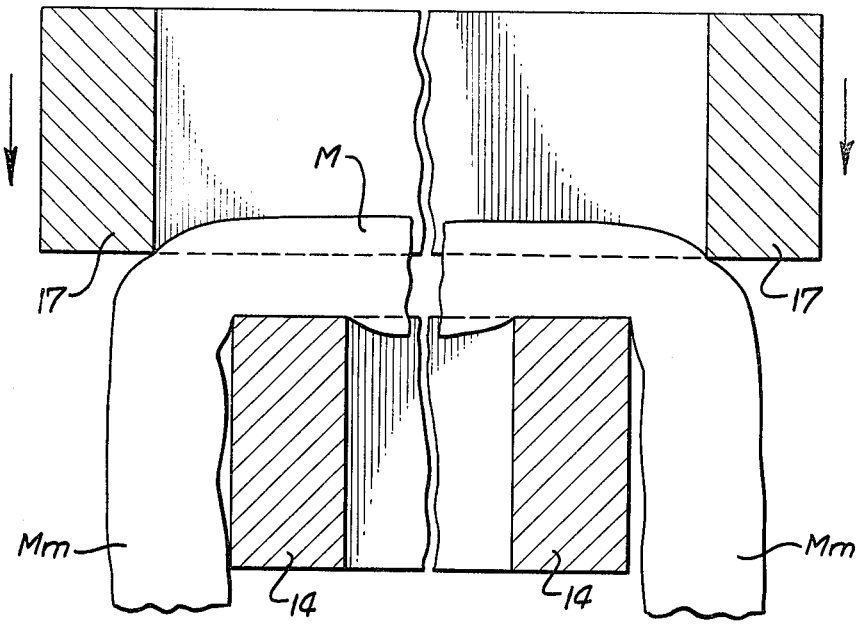
FIG. 3 is an enlarged and broken away diagrammatic detailed vertical sectional view taken on the line 3—3 of FIG. 2 and showing the same uniform horizontal space between the inner and outer frames, as in FIG. 2, but to full scale, e.i., with the dimensions being of actual size and showing a starting step in the operation of the invention in which the outer frame is uniformly expanded as above indicated and then lowered to come to rest on a matrix three quarters of an inch in thickness previously laid out to horizontally rest on and overlie the inner frame. As shown in this view the matrix, at this point, exerts enough resistance to being bent downward, to temporarily sustain the weight of the outer frame, resting on the matrix.

After the apparatus 10 is set up for use, by unfolding the legs, the clamps 19 are slightly relaxed to allow outer frame 12 to be slipped vertically upwardly off of inner frame 11 and set to one side while the quilting matrix M is prepared and draped over the inner frame, so as to allow marginal areas Mm to overhang inner frame members 13 and 14 as shown in FIG. 3.

Clamps 19 having been fully opened ambidextrously so as to space outer frame members 16 and 17 uniformly ½" outwardly respectively from inner frame members 13 and 14 (when outer frame 12 is centered on inner frame 11) the outer frame is thus manually suspended, with one hand holding to each of clamps 19, and lowered thus to rest on the depending marginal areas Mm of the Matrix M. As shown in FIG. 3, the bulk of the Matrix M is normally adequate to support the weight of outer frame 12 when thus expanded and superposed on said matrix.

Should the bulk of the matrix prove inadequate to, of itself, support the outer frame 12 fully expanded, the clamps 19 would be uniformly contracted by simultaneously manually tightening wing nuts 26 until such support is attained.

Figure 4:
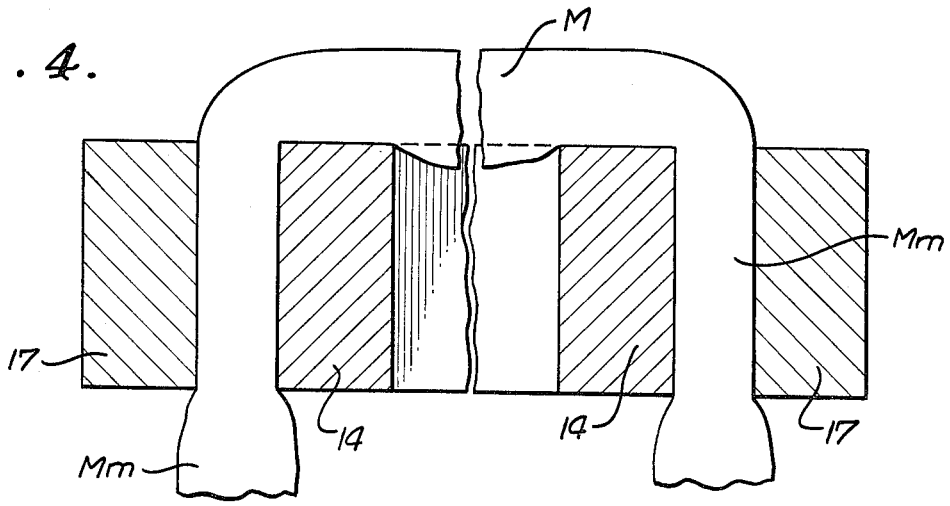
FIG. 4 is a view similar to FIG. 3 and illustrates the next step in the operation of the invention which is performed by the operator manually depressing the outer frame from the position in which it is shown in FIG. 3, to its position in FIG. 4, in which the one-half inch uniform radial spacing is maintained between the inner and outer frames while gently wiping the outer frame downwardly over the matrix until it is compressed from a thickness of three quarters of an inch to a thickness of one-half inch without applying an excessive pressure to the matrix.
Figure 5:
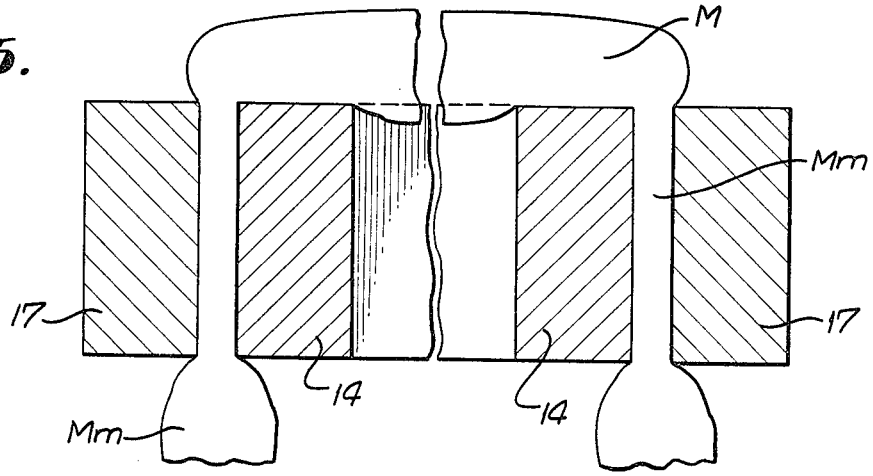
FIG. 5 is a view similar to FIG. 4 and illustrates the next following step in the operation of the invention in which the operator uniformly and simultaneously tightens both the diagonally opposite wing nuts controlling the contraction of the outer frame until the thickness of the marginal matrix portions located directly between the two frames has been reduced to approximately one-quarter inch.

The next step in the practice of the invention is to manually depress the outer frame 12 to a co-planar level outside frame 11 as shown in FIG. 4. Having reached this position without danger of scuffing the fabric coverings of the matrix, the next step of simultaneously manually tightening clamps 19 as shown in FIG. 5 locks the matrix on four sides by the manipulation of only two clamps giving a maximum security and taughtness to the matrix without any occasion for damaging the work.

The hand needlework may now proceed with the greatest facility. Upon its completion, the two clamps 19 are simultaneously loosened completely, the outer frame slipped easily upward from the matrix and set aside while the finished work is lifted from the inner frame and replaced by a new matrix M.

I claim:

1. In a quilting matrix supporting apparatus, the combination of:

an inner rigid horizontal rectangular matrix-supporting frame;

an outer rectangular frame snugly fitting around said inner frame in co-planar relationship therewith, said outer frame being divided approximately along one of its diagonals into two right-angle-forming sections, each section embodying two contiguous rigidly united members of said outer frame; and manually operable clamp means located at the apices of said diagonal of said outer frame to expansibly and contractibly unite the contingent pairs of ends of said two sections into which said outer frame is divided.

2. A combination as recited in claim 1 wherein each of said two clamp means comprises: a pair of angle brackets subtending angles of one hundred thirty-five degrees and rigidly secured to the converging external contiguous faces of the aforesaid right angle forming sections into which said outer frame is diagonally divided;

parallel corner lugs being formed by said pair of brackets and having aligned holes normal to said lugs;

a clamp bolt slideably received in said aligned holes; and a wing nut screwed onto said bolt.

3. A combination as recited in claim 2, wherein both inner and outer frames are formed of ¾"×1⅝" smoothly finished hardwood and all frame members are mitered with angles of 45° at their ends, and wherein the bolt and wing nut clamps, when fully applied, with the apparatus empty and with the frames in co-planar relation, tightly clamps the frames together for convenient storage.

* * * * *